US006871175B2

(12) United States Patent
Amano

(10) Patent No.: US 6,871,175 B2
(45) Date of Patent: Mar. 22, 2005

(54) VOICE ENCODING APPARATUS AND METHOD THEREFOR

(75) Inventor: Fumio Amano, Kawasaki (JP)

(73) Assignee: Fujitsu Limited Kawasaki, Kawasaki (JP)

( * ) Notice: Subject to any disclaimer, the term of this patent is extended or adjusted under 35 U.S.C. 154(b) by 607 days.

(21) Appl. No.: 09/816,032

(22) Filed: Mar. 22, 2001

(65) Prior Publication Data

US 2002/0065648 A1 May 30, 2002

(30) Foreign Application Priority Data

Nov. 28, 2000 (JP) ..... 2000-361874

(51) Int. Cl.[7] ..... G10L 19/00
(52) U.S. Cl. ..... 704/216; 704/258
(58) Field of Search ..... 704/216, 258, 704/270

(56) References Cited

U.S. PATENT DOCUMENTS

| | | | | | |
|---|---|---|---|---|---|
| 4,002,841 | A | * | 1/1977 | Ching et al. | 370/435 |
| 5,115,469 | A | * | 5/1992 | Taniguchi et al. | 704/228 |
| 5,241,535 | A | * | 8/1993 | Yoshikawa | 370/394 |
| 5,550,543 | A | * | 8/1996 | Chen et al. | 341/94 |
| 5,583,887 | A | * | 12/1996 | Murata et al. | 375/229 |
| 5,787,389 | A | * | 7/1998 | Taumi et al. | 704/219 |
| 5,857,000 | A | * | 1/1999 | Jar-Ferr et al. | 375/240 |
| 5,867,814 | A | * | 2/1999 | Yong | 704/216 |
| 6,161,091 | A | * | 12/2000 | Akamine et al. | 704/258 |
| 6,430,500 | B1 | * | 8/2002 | Kubota et al. | 701/209 |

OTHER PUBLICATIONS

"A survey of Packet Loss Recovery Techniques for Streaming Audio". By Colin Perkins, Orion Hodson, and Vicky Hardman IEEE Network, Sep./Oct. 1998 pp. 40–48.

"Internet Telephony: Services, Technical Challenges, and Products" by Mahbub Hassan, Alfandika Nayandoro & Mohammed Atiquzzman, IEEE Communications Magazine, Apr. 2000, pp. 96–103.

"A pattern Recognition Approach to Voiced–Unvoiced–Silence Classification with Applications to Speech Recognition", by Bishnu S. Atal and Lawrence R. Rabiner, IEEE Transactions on Acoustics, Speech, and Signal Processing, vol. ASSP–24, No. 3, Jun. 1976 pp. 201–212.

"Waveform Substitution Techniques for Recovering Missing Speech Segments in Packet Voice Communications" by David J. Goodman, Gordan B. Lockhart, Ondria J. Wasem, and Wai–Choong Wong IEEE Transactions on Acoustics, Speech, and Signal Processing, vol. ASSP–34, No. 6, Dec. 1986 pp. 1440–1447.

(List continued on next page.)

*Primary Examiner*—Doris H. To
*Assistant Examiner*—Michael A Lewis
(74) *Attorney, Agent, or Firm*—Katten Muchin Zavis Rosenman

(57) ABSTRACT

A voice encoding method includes the steps of encoding a first frame that contains a plurality of voice data into encoded parameters, locally decoding the encoded parameters of the first frame into a second frame, performing a plurality of interpolation recovery processes that generate respective frames approximating to the first frame by using a frame or frames other than the first frame, comparing the second frame with the frames approximating to the first frame generated by the plurality of interpolation recovery processes, calculating a signal to noise ratio of each of the frames approximating to the first frame by treating the second frame as the signal, determining an index number that indicates an interpolation recovery process which provides a highest signal to noise ratio, and multiplexing and transmitting the index number with the encoded parameters.

11 Claims, 11 Drawing Sheets

OTHER PUBLICATIONS

"Model–Based Multirate Representation of Speech Signals and Its Application to Recovery of Missing Speech Packets" by You–Li Chen and Bor–Sen Chen IEEE Transactions on Speech and Audio Processing, vol. 5, No. 3 May 1997, pp. 220–231.

Nikkei Communications Mar. 15, 1999, pp. 120–126, "IP Telephone Technology: Large–Network–Oriented Technology Developed at Rapid Pace as Support for Telephone Network of the 21 Century," printed by Nikkei BP ini Japan.

Nikkei Communications Feb. 1, 1999, pp–126–133, "VoIP Gateway: Relaying Audio through IP Network, Generating Significant Difference in the Maximum Number of Calls," printed by Nikkei BP in Japan.

Interface Aug. 1998, pp–119–124, "Technology for Transferring Audio over the Internet–Voice over IP," printed by CQ Publishing in Japan.

* cited by examiner

FIG.9

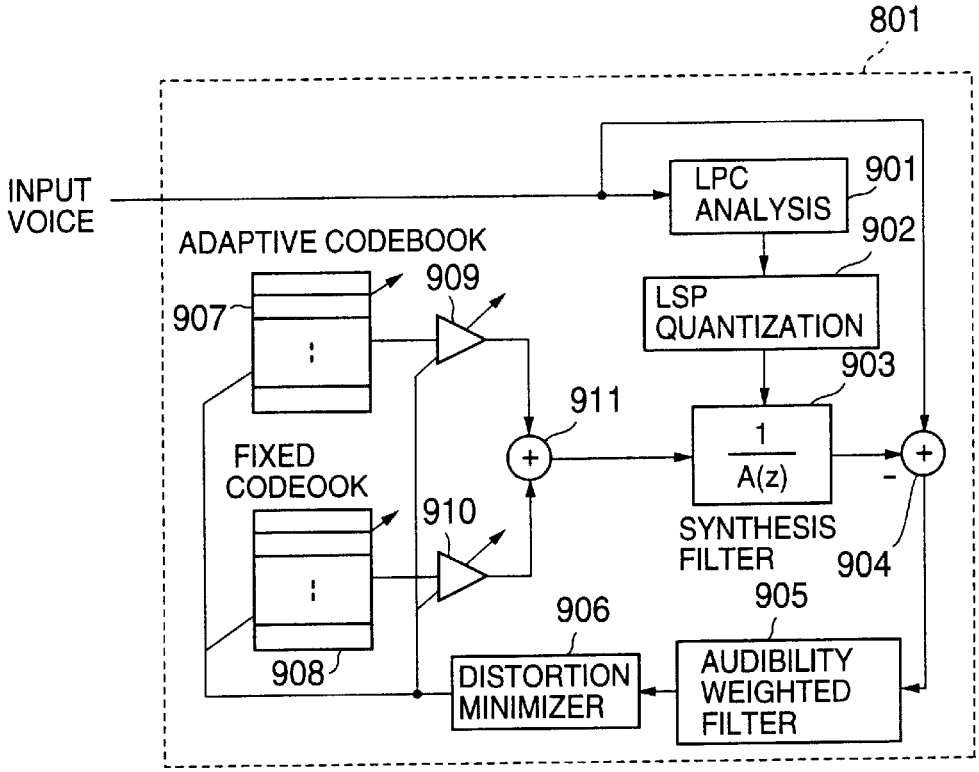

FIG.10

FRAME

| LPC ANALYSIS PARAMETERS | | | |
|---|---|---|---|
| ADAPTIVE CODEBOOK INDEX #1 | ADAPTIVE CODEBOOK INDEX #2 | ADAPTIVE CODEBOOK INDEX #3 | ADAPTIVE CODEBOOK INDEX #4 |
| ADAPTIVE CODEBOOK GAIN #1 | ADAPTIVE CODEBOOK GAIN #2 | ADAPTIVE CODEBOOK GAIN #3 | ADAPTIVE CODEBOOK GAIN #4 |
| FIXED CODE-BOOK INDEX #1 | FIXED CODE-BOOK INDEX #2 | FIXED CODE-BOOK INDEX #3 | FIXED CODE-BOOK INDEX #4 |
| FIXED CODE-BOOK GAIN #1 | FIXED CODE-BOOK GAIN #2 | FIXED CODE-BOOK GAIN #3 | FIXED CODE-BOOK GAIN #4 |

920

SUBFRAME

VOICE ENCODING APPARATUS AND METHOD THEREFOR

BACKGROUND OF THE INVENTION

1. Field of the Invention

The present invention generally relates to a voice encoding method for voice transmission through an IP (Internet protocol) network, and particularly relates to the voice encoding method that alleviates deterioration in voice quality at a receiving end when a packet is lost in the transmission.

2. Description of the Related Art

VOIP (Voice Over IP) has been known as a technology to transmit voice over an IP network. FIG. 1 shows a basic structure of a VOIP transmission system. The VOIP transmission system is principally comprised of such user terminals as telephone sets 101 and 107, access/conventional networks 102 and 106, VOPI gateways (VOIPGW) 103 and 105 and the Internet 104. VOIPGW 103 and 105 are located in between the access/conventional networks 102 and 106 and the Internet 104, respectively. FIG. 2 shows a basic structure of a voice processing unit of the VOIPGW. The VOIPGW voice processing unit is principally comprised of an access/conventional network interface 201, a voice encoding unit 202, a packet assembling unit 203, a voice decoding unit 204 and a packet disassembling unit 205. In VOIP, a voice signal that is input to the VOIPGW 103 and 105 from the access/conventional networks 102 and 106, respectively, is transmitted after encoding by the voice encoding unit 202 at a low bit rate. The encoded voice signal is multiplexed with data packets, thereby economizing the cost of voice communication.

However, the basic structure as shown in FIG. 1 suffers problems as follows. One of the problems is that a delay time becomes lengthy as packets are transmitted via a plurality of routers in the IP network. The second problem is that there is a fluctuation (i.e., jitter) in the time of packet arrivals as the packets are transmitted via various buffers. The third problem is that a packet may be lost due to data overflow at these buffers or due to errors occurring during data transmission, which deteriorates quality of voice reproduced at a receiving end.

Conventional techniques for compensating for lost packets on the transmitting side are as follows, for example. The first technique is to return information about the packet loss from the receiving end to the transmitting side so that a frame corresponding to the lost packet is retransmitted. The second technique employs an interleave process, which alleviates an effect of packet loss by randomizing errors. The third technique employs an FEC (Forward Error Correction) encoding.

Examples of conventional techniques that can be employed on the receiving side are as follows. The first is a method of inserting a waveform with respect to a lost frame. The second method interpolates a waveform from waveforms of the frames preceding and following the lost frame, or interpolates a waveform from a waveform of the preceding frame. The third method is to interpolate voice codec parameters from those of preceding and following frames so as to reproduce voice from the interpolated parameters. These techniques are described in "A Survey of Packet Loss Recovery Techniques for Streaming Audio," IEEE Network Magazine, the September/October issue, pp.40–48, 1998, and "Internet Telephony: Services Technical Challenges, and Products," IEEE Communication Magazine, the April issue, pp 96–103, 2000.

The first and the second techniques employed on the transmitting side are principally used in delivery services where time delays are permissible. FIG. 3 shows an example of a media specific interpolation process that corresponds to the third technique employed on the transmission side described above.

In FIG. 3, frames of an original voice stream are referred to by reference numerals 301 through 304. In this example, four frames are shown. Here, the frame 303 is coded into an coded parameter 313-3 that is ordinarily used, and is also encoded into another coded parameter 314-3 corresponding to a voice encoder having a bit rate lower than the ordinarily used bit rate. The coded parameter 313-3 that is ordinarily used and the coded parameter 314-3 corresponding to the lower bit rate voice encoder are inserted into a frame 313 and a frame 314, respectively, which have respective FEC codes added thereto, and are then transmitted as packets. If the packet 313 is lost during the transmission, the encoded parameter 314-3 of the lower bit rate voice encoder is used in place of the ordinarily used encoded parameter 313-3, thereby reproducing a waveform corresponding to the voice frame 303 that should have been transmitted by the packet 313. The processing delay in this method is one frame interval. In order to obtain voice quality of a desired level, the lower bit rate encoder is required to be capable of encoding at about 2 to 4 kbps. Accordingly, redundant data (i.e., overhead) of about 40 to 80 bits is necessary to add the encoded parameter 314-3 of the lower bit rate voice encoder in the case of a frame length of 20 msec.

Conversely, in the conventional techniques where the lost packet is interpolated on the receiving end, the interpolation process can be performed without the overhead. FIG. 4 shows a basic structure for performing a conventional interpolation method on the receiving end. FIG. 4 shows the voice decoding unit 204 that principally includes a packet disassembling unit 401, a voice decoding unit 402, and an interpolation process unit 403. An encoded parameter output from the packet disassembling unit 401 is provided to the voice decoding unit 402, which reproduces and outputs a voice waveform. If there is a packet loss in the received packets, a packet loss index indicative of the lost packet is supplied to the interpolation process unit 403. The interpolation process unit 403 performs an interpolation process, an example of which will be described in the following.

A first example is to multiply a reproduced waveform by a window function where the reproduced waveform is that of a frame preceding the lost packet, and uses the obtained waveform as the waveform of the frame that has suffered the packet loss. Alternatively, a second example is to interpolate coded parameters from frames preceding and following the frame that has suffered packet loss, thereby reproducing the voice of the frame of packet loss based on the interpolated parameters. In this case, LPC (Linear Prediction Coding) parameters, for example, are obtained by linear interpolation from parameters obtained from the frames preceding and following the frame of packet loss. As for other parameters, the same parameter values as those of the preceding frame are used.

It has been known that the method based on parameter interpolation has an advantage of better reproduction quality over other techniques employed on the receiver end for interpolating and recovering the lost packet. However, this method has following problems.

A first problem is that, despite presence of a plurality of available interpolation and recovery processes, the conventional method is configured to use only one of such processes. Accordingly, the process employed for interpolation and recovery of a lost packet may not be the best method from the viewpoint of an S/N (signal to noise) ratio or the viewpoint of subjective quality.

A second problem is that if the lost packet contains a consonant section, the interpolation recovery process may still loose clarity of voice.

HoHooHo

SUMMARY OF THE INVENTION

It is a general object of the present invention to provide a voice encoding scheme that substantially obviates one or more of the problems caused by the limitations and disadvantages of the related art.

It is another and more specific object of the present invention to provide a voice encoding method employing a packet recovery process, which is capable of providing a high S/N ratio and high subjective quality, and is capable of providing clear voice during consonant intervals.

To achieve the first part of the object, a plurality of interpolation recovery processes are provided on the transmitting side. On the transmitting side, each and every frame is assumed to be lost, and all the interpolation recovery processes are performed with respect to each frame. Waveforms that are interpolated and recovered are compared with a waveform that is locally decoded and reproduced from the relevant packet. An interpolation recovery process that provides the closest waveform to the locally decoded and reproduced waveform is determined. An index number of this process is transmitted with the packet to the receiver end. At the receiving end, the plurality of interpolation recovery processes are provided in the same manner as in the transmitting end. When packet loss is detected, an interpolation recovery process indicated by the index number that is transmitted together with the frame is used to select a proper interpolation process, which is then performed. In this manner, the present invention obtains an interpolated and recovered waveform closest to the waveform that would have been recovered if the packet had not been lost.

For the second part of the object described above, a detection process is performed frame by frame on the transmitting side to detect whether a frame contains a consonant interval. If a consonant is included in the frame, the frame is transmitted with higher priority. The higher priority may be attained by transmitting the frame having a consonant a number of times. Alternatively, if a setting can be made to indicate frame priority, the frame having a consonant is given a setting indicative of higher priority.

Other objects and further features of the present invention will be apparent from the following detailed description when read in conjunction with the accompanying drawings.

BRIEF DESCRIPTION OF THE DRAWINGS

FIG. 9 shows a basic structure of a CELP encoder;

FIG. 10 shows transmission timing of parameters;

DESCRIPTION OF THE PREFERRED EMBODIMENTS

In the following, embodiments of the present invention will be described with reference to the accompanying drawings.

Figure 1:
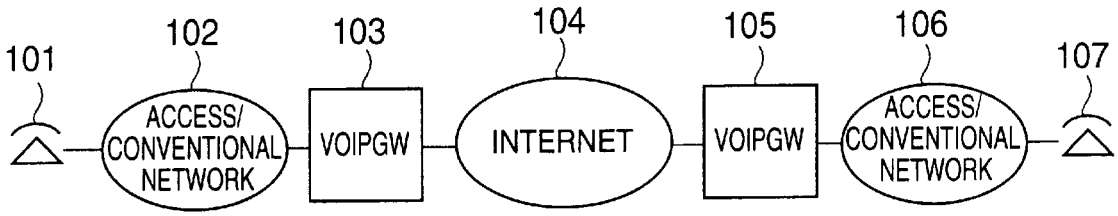
FIG. 1 shows a basic structure of a VOIP transmission system.
Figure 2:
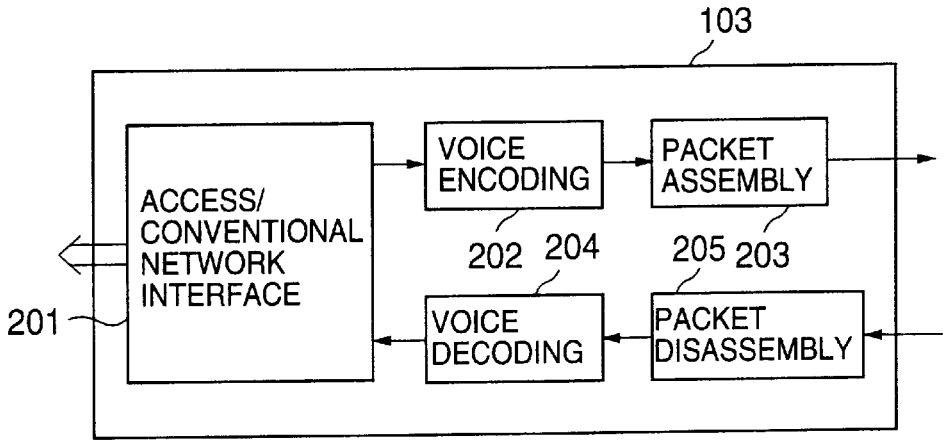
FIG. 2 shows a basic structure of a VOIPGW voice processing unit.
Figure 5A:
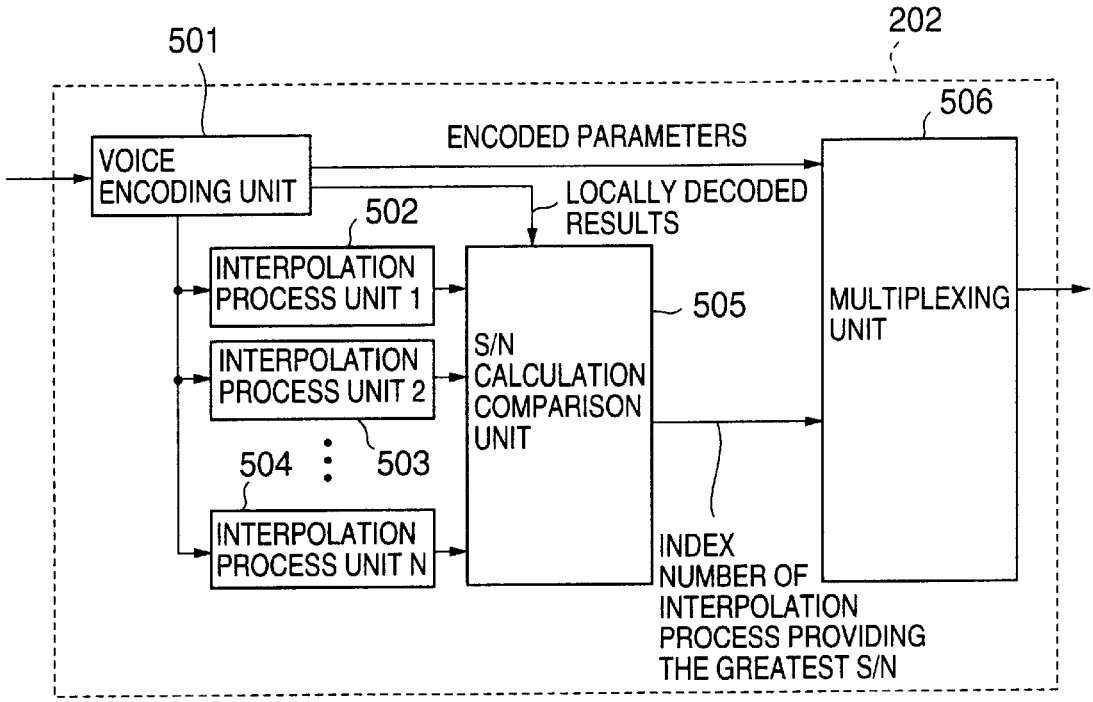
FIG. 5A is a block diagram of the transmitting end (encoding side) according to a first embodiment.
Figure 5B:
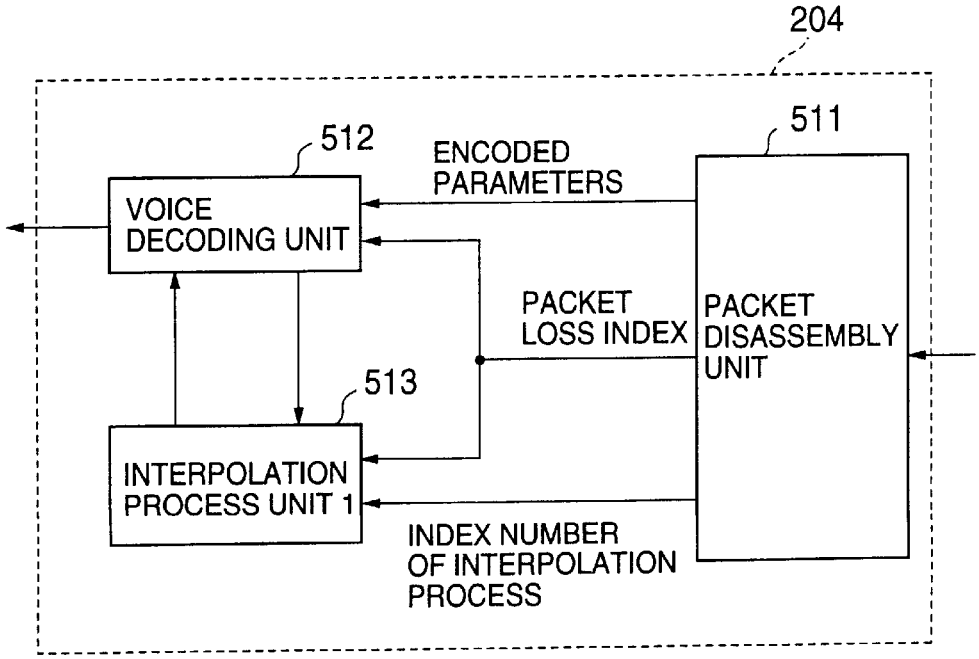
FIG. 5B is a block diagram of the receiving end (decoding side) according to the first embodiment.

The present invention is applied to the VOIPGWs 103 and 105 as shown in FIG. 1. FIGS. 5A and 5B show a structure of a first embodiment of the present invention, which solves the first problem mentioned above. FIG. 5A exhibits a sample structure of the voice encoding unit 202 provided on the transmitting side shown in FIG. 2. FIG. 5B exhibits a sample structure of the voice decoding unit 204 on the receiving end shown in FIG. 2. The voice encoding unit 202 includes principally a voice encoding unit 501, a plurality of interpolation processing units such as interpolation processing units 502 through 504, an S/N calculation comparison unit 505 and a multiplexing unit 506. The voice encoding unit 501 includes a local decoding unit that locally decodes parameters encoded in the encoding unit. The local decoding unit may share components with an encoding part of the encoding unit. The voice decoding unit 204 includes a disassembly unit 511, a voice decoding unit 512, an interpolation processing unit 513. On the transmitting side, the interpolation processing units 502 through 504 always assume that a frame is lost, and attempt their respective interpolation recovery processes. Then, waveforms interpolated and recovered by the interpolation recovery units 502 through 504 are compared with a waveform locally decoded from the relevant packet by the voice encoding unit 501. This comparison is made with respect to S/N ratios by the S/N calculation comparison unit 505. An index number, which indicates an interpolation and recovery process of the interpolation processing unit that has provided the highest S/N, is supplied to the multiplexing unit 506, by which the index number is multiplexed with the encoded parameters, followed by transmission thereof. On the receiving end, when there is no packet loss, a voice decoding process is performed by the voice decoding unit 512 using the encoded parameters output from the disassembly unit 511. When a packet loss is detected at the disassembly unit 511, an interpolation recovery process is carried out by using the index number of the interpolation recovery processing method that is received from the transmission side.

Figure 6:
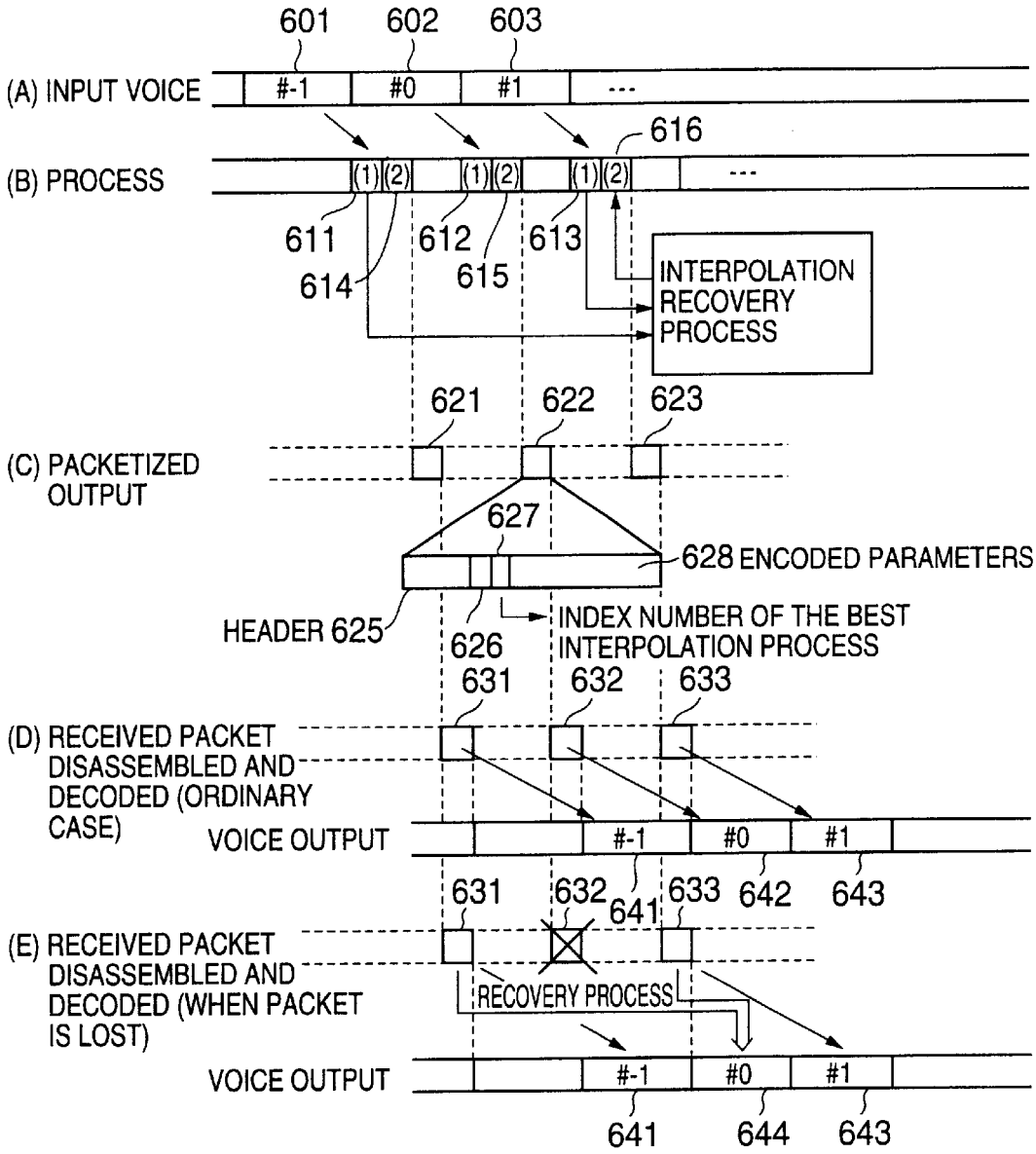
FIG. 6 is an illustrative drawing showing a process of the first embodiment of the present invention.

FIG. 6 is an illustrative drawing showing a process of the first embodiment of the present invention. In FIG. 6, (A)

shows input voice signal frames 601, 602 and 603. (B) shows process intervals 611 through 616. (C) shows output packets 621, 622 and 623, as well as an example structure of the packet 622. (D) shows received packets 631, 632 and 633 on the receiving end when there is no packet loss and decoded voice outputs 641, 642 and 643, respectively. When there is a packet loss, the received packets 631, 632 and 633 and their respective decoded voice outputs 641, 644 and 643 are as shown in (E).

Figure 7:
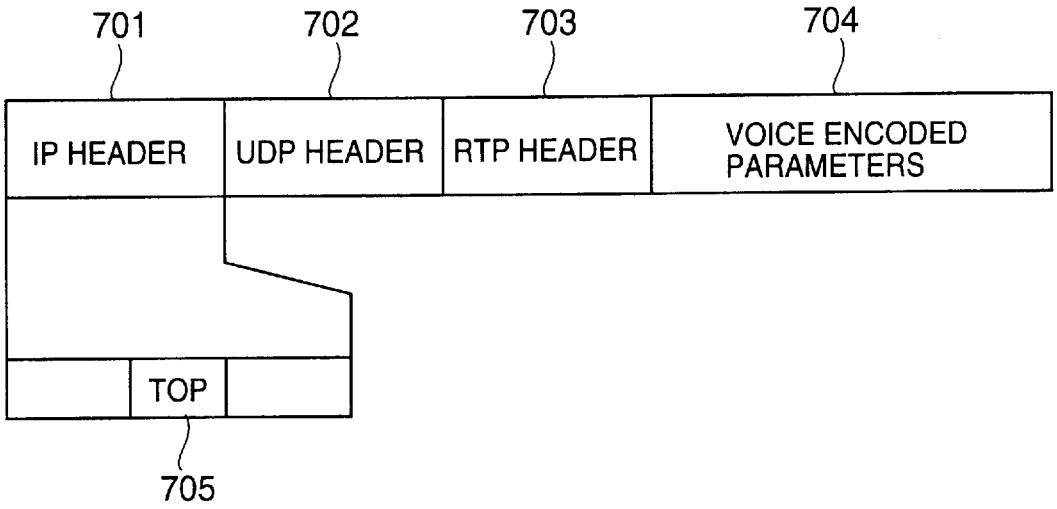
FIG. 7 shows an example of packet structure.

On the transmitting side, the voice input frames 601, 602 and 603 are encoded during the process intervals 611, 612 and 613, respectively. Further, during the process intervals 614, 615 and 616, interpolation recovery processes take place at the interpolation process units 502, 503 and 504, respectively, as described above, assuming that every one of the packets is lost. For example, during the process interval 616, these interpolation recovery processes are performed for the frame 602 by using the encoded parameters of the frames 601 and 603. An index number indicative of the interpolation recovery process that provides the highest S/N is identified, and is packetized together with the encoded parameter. The packet may be composed of, for example, a header 625, a control bit portion 626, the index number 627 of the selected optimum interpolation process, and the encoded parameter 628. FIG. 7 shows another example of the structure of a packet. Here, the packet includes an IP header 701, a UDP header 702, an RTP header 703, and voice encoded data 704. The index number obtained as above may be loaded at an unused area such as bits 6 and 7 of a TOS (Type Of Service) field 705 in the IP header 701. By loading the index number outside the encoded data area 704 of the packet, the index number can be transmitted without deteriorating voice quality. Similarly, if there is an unused area available in the RTP header 703, the index number may be loaded into this area. Further, in the encoded data area 704, there is an area whose error sensitivity is low. Therefore, the obtained index number may be loaded to the area that has the lowest error sensitivity, minimizing an impact on the voice quality when sending the index number in the encoded data area 704.

In an implementation where the index number is loaded into the least error sensitive area of the encoded data area 704, the index number may be transmitted once in several frames, thereby further minimizing voice quality deterioration. In this case, the process mentioned above is performed once in several frames. Alternatively, the process may be performed and the index number may be transmitted only when the encoded parameters greatly differ between adjacent frames.

On the receiving end, the voice outputs 641, 642 and 643 are generated by decoding the received packets 631, 632 and 633 by using the encoded parameters for each of the frames as shown in FIG. 6, (D). On the other hand, if the packet 632 was lost, for example, as shown in (E), the voice frame 644 is reproduced by an interpolation recovery process using the frames 631 and 633 and the index number received together with these frames.

Figure 8A:
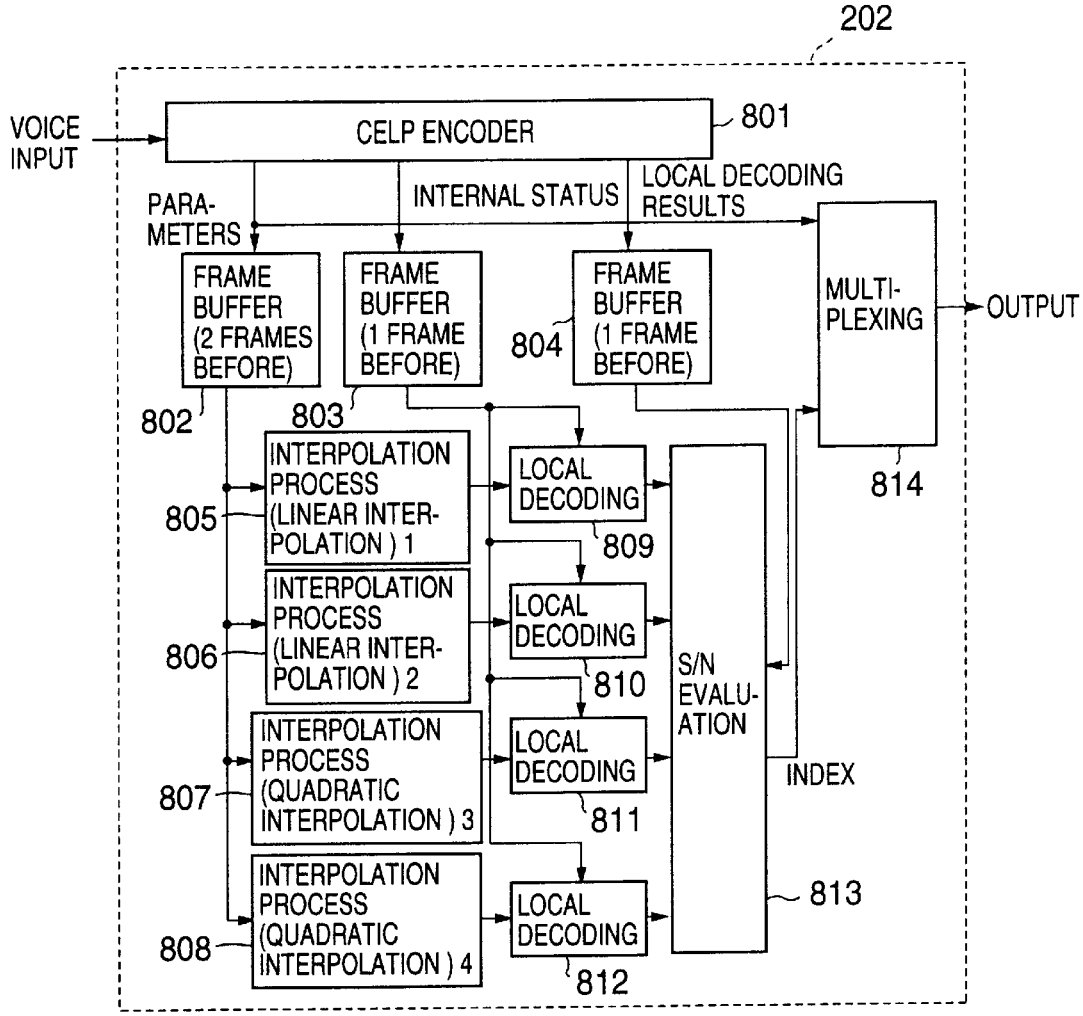
FIG. 8A is a block diagram of an encoder according to a second embodiment.

Here, a second embodiment of the present invention is described. FIG. 8A shows an embodiment wherein the CELP method is employed in the voice encoding. The voice encoding unit 202 includes a CELP encoder 801, frame buffers 802, 803 and 804, interpolation processing units 805, 806, 807 and 808, local decoding units 809, 810, 811 and 812, an S/N calculation comparison unit 813, and a multiplexing unit 814. FIG. 9 is a block diagram of the CELP encoder 801, comprising principally an LPC analysis unit 901, an LPC quantization unit 902, a synthesis filter unit 903, a subtraction unit 904, an audibility weight filter unit 905, a distortion minimizing unit 906, an adaptive codebook 907, a fixed codebook 908, gain adjustment units 909 and 910, and an adder 911.

The CELP method is a voice compression method wherein a most appropriate codebook is selected by AbS (Analysis by Synthesis). In the CELP encoder 801, LPC parameters are computed by an LPC analysis unit 901 for every frame that is 20 msec long, for example. Further, an index and a gain in an adaptive codebook and an index and a gain in a fixed codebook that provide the best voice quality are computed and output for every subframe that is 5 msec long, for example. FIG. 10 shows relationships between frames and subframes. In FIG. 8A, the parameters that are computed by the CELP encoder 801 as described above are stored in the frame buffer 802 for two previous frames. Similarly, the internal state of the local decoder and an output of the synthesis filter 903 for a frame immediately preceding the current frame are stored in the frame buffers 803 and 804, respectively. Further, interpolation recovery processes are performed by the interpolation processing units 805 through 808 for every frame, assuming that the frame immediately preceding the current frame is lost.

In the interpolation processing unit 805 shown in FIG. 8A, a linear interpolation process is performed for the LPC parameters by using the values of the frame before the last and the values of the frame of the present. As for the index and gain of the adaptive codebook and the index and gain of the fixed codebook, values of the fourth subframe of the frame before the last are used without any change for all the four subframes.

In the interpolation processing unit 806 in FIG. 8A, a linear interpolation process is performed on the LPC parameters in the same manner as in the interpolation processing unit 805. As regards the index and gain of the adaptive codebook and the index and gain of the fixed codebook, values of the third subframe of the second last frame is used for a first subframe, and values of the fourth subframe of the second last frame is used for a second subframe, with values of the first subframe of the present frame being used for a third subframe, and values of the second subframe of the present frame being used for a fourth subframe.

In the interpolation processing unit 807 shown in FIG. 8A, interpolation of the LPC parameters is performed by using the values of the second preceding frame and the values of the present frame based on the quadratic function interpolation. Other parameters are obtained in the same manner as performed by the interpolation processing unit 805.

In the interpolation processing unit 808, the LPC parameter interpolation is performed by using the values of the second preceding frame and the values of the present frame by the quadratic function interpolation. Other parameters are obtained in the same manner as performed by the interpolation processing unit 806. The local decoding units 809, 810, 811 and 812 carry out local decoding by using the four parameters obtained from the interpolation process as described above. Further, an output of the local decoding using encoded parameters of the frame immediately preceding the present frame is compared with the outputs of the local decoding units 809, 810, 811 and 812 by the S/N calculation comparison unit 813, thereby obtaining S/N values. An interpolation method that provides the largest S/N value is selected, an index number of which is multiplexed with the CELP encoded parameters by the multiplexing unit 814. The multiplexed signal is provided to the packet assembly unit 203.

For example, indices 00, 01, 10 and 11 are assigned to the processes of the interpolation processing units 805, 806, 807 and 808, respectively. If the interpolation processing unit 807 provides the highest S/N value of the four, for example, the index number 10 is multiplexed.

The processes described above may be implemented as a firmware process of a DSP (Digital Signal Processor).

Figure 8B:
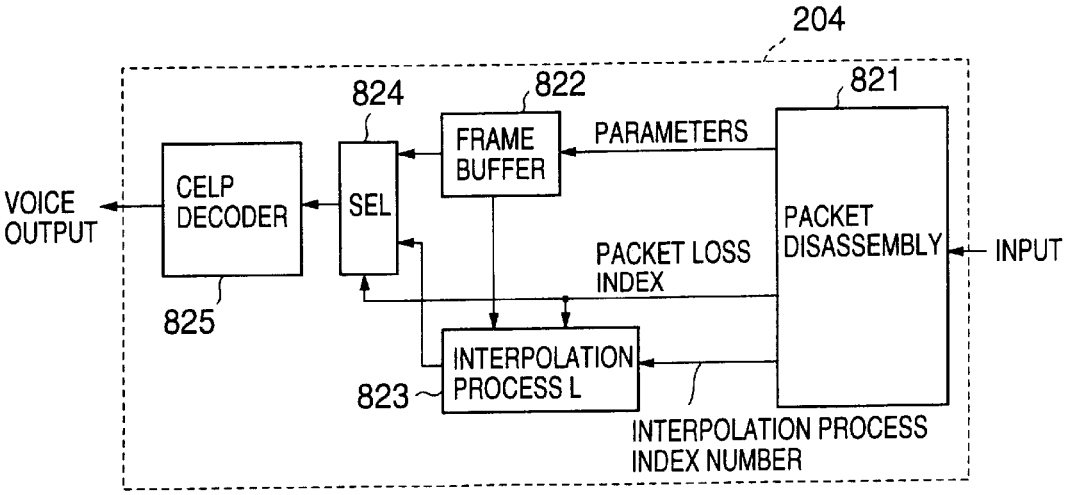
FIG. 8B is a block diagram of a decoder according to the second embodiment.

FIG. 8B shows a structure of a decoder. The voice decoding unit 204 includes a packet disassembly unit 821, a frame buffer 822, an interpolation processing unit 823, a selector 824 and a CELP decoder 825. The received encoded parameter is disassembled by the packet disassembly unit 821, and, then, is stored in the frame buffer 822, which has a storage capacity for two frames. If frame loss is reported by a received packet loss index, the interpolation processing unit 823 performs an interpolation recovery process of the most appropriate interpolation process indicated by the index number.

Figure 11:
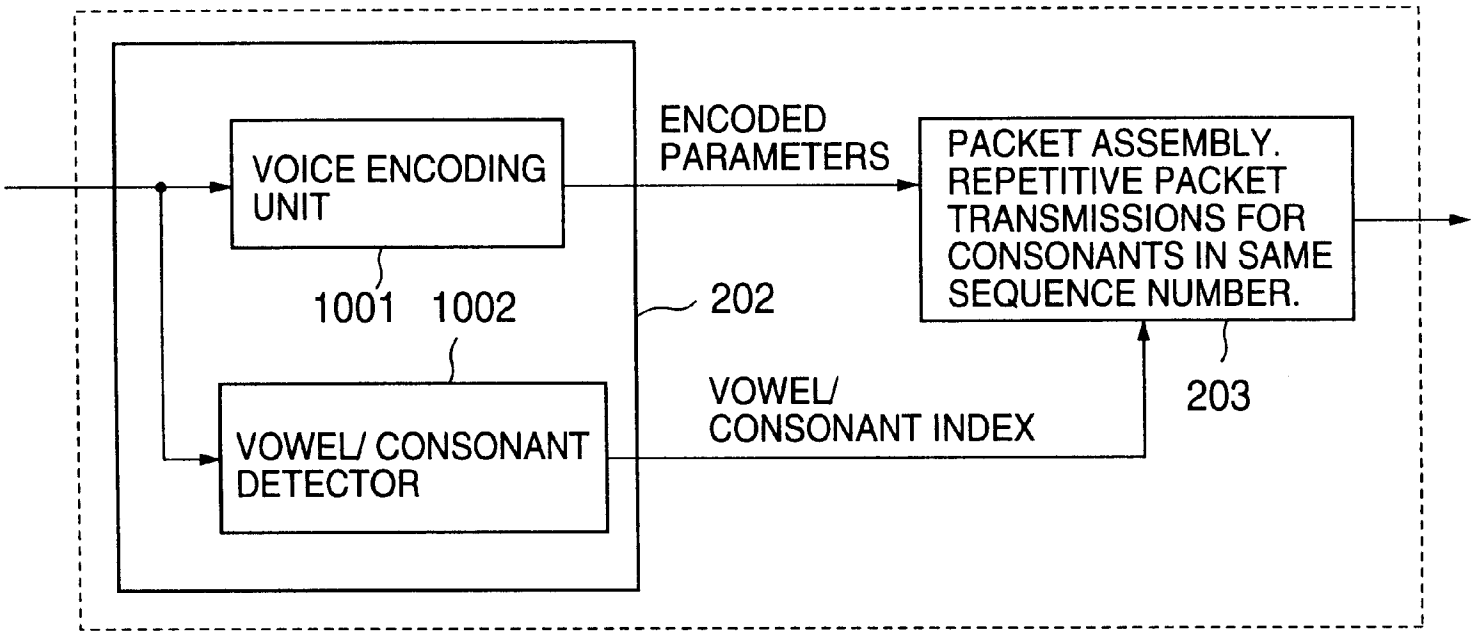
FIG. 11 is a block diagram of a voice encoding unit and a packet assembly unit according to a third embodiment of the present invention.

FIG. 11 shows a third embodiment of the present invention, in which examples of the voice encoding unit 202 and the packet assembly unit 203 are shown. The voice encoding unit 202 includes a voice encoding means 1001 and a vowel/consonant detection unit 1002. Input voice is encoded by the voice encoding unit 1001 while the presence or absence of consonants is checked by the vowel/consonant detection unit 1002 for each frame. If an interval that contains a consonant is detected, the detection result is provided to the packet assembly unit 203 together with the encoded parameters. If the frame contains a consonant interval, the packet assembly unit 203 transmits the same frame a number of times with the same sequence number attached thereto until the time comes for the next frame to be processed. This is done while monitoring occupancy of the packet transmission buffer.

Figure 12:
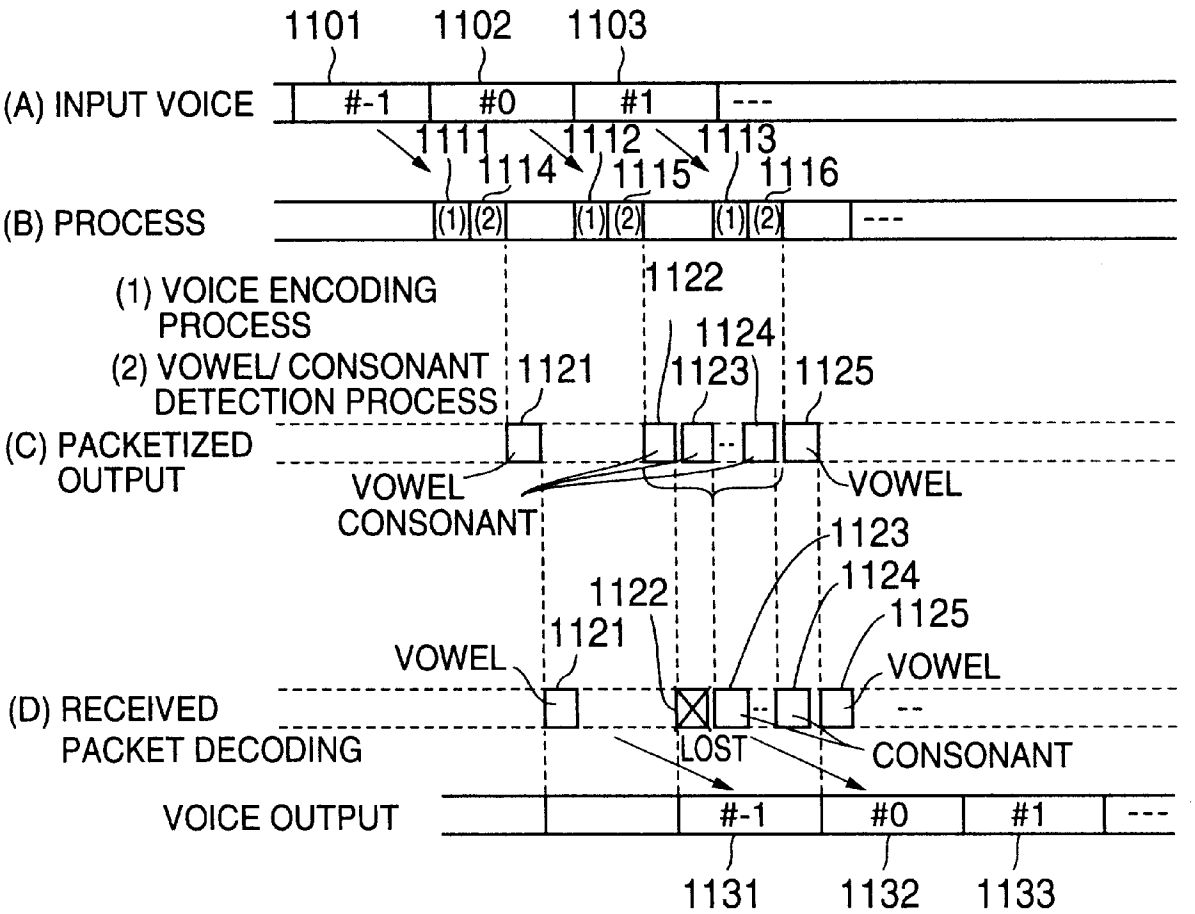
FIG. 12 is an illustrative drawing showing processes of the third embodiment of the present invention.

FIG. 12 is an illustrative drawing showing processes of the third embodiment of the present invention. In FIG. 12, (A) indicates input voice signal frames 1101, 1102 and 1103. (B) indicates process intervals 1111 through 1116. (C) indicates output packets 1121 through 1125. (D) shows packets 1121 through 1125 that are received on the receiver side in the case that a packet containing a consonant is lost, and also shows their respective decoded voice outputs 1131, 1132 and 1133.

On the transmission side, the input voice frames as shown in (A) of FIG. 12 are encoded by the voice encoding unit 1001 during the process intervals 1111, 1112, and 1113, as shown in (B). During the process intervals 1114, 1115, and 1116, further, the consonant detection unit 1002 checks whether a consonant interval is included in these frames. For example, if the frame 1102 is found to contain a consonant interval, the packet assembly unit 203 transmits the same frame a number of times with a same sequence number attached thereto as exemplified by the frames 1122, 1123 and 1124. This is done while monitoring occupancy of the packet transmission buffer until the next frame 1103 is processed.

The receiving side expects to receive the next packet 1122 within a certain time period from the receiving of the packet 1121. If the next packet 1122 is not received at an anticipated timing, packet loss is suspected, so that the receiving side waits for a subsequent packet during the time period in which the same frame having the same sequence number is transmitted a number of times. If the packet 1123 with the same sequence number attached thereto is received during this time period, the frame 1132 is decoded from this received packet.

Figure 3:
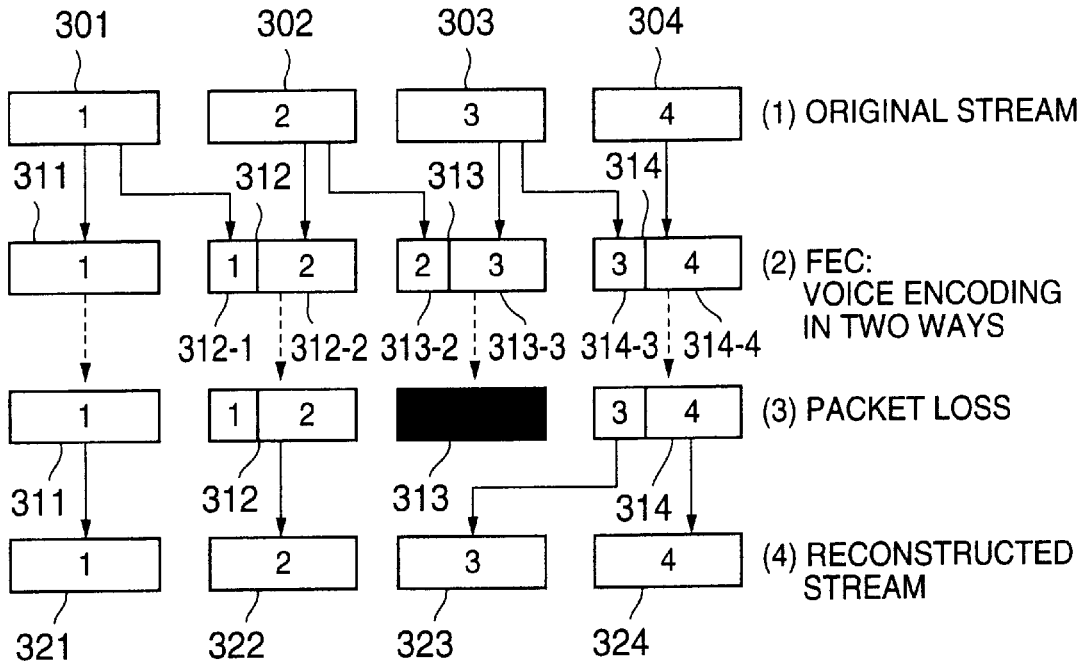
FIG. 3 shows an example of a conventional media specific interpolation process on the transmitting side.
Figure 4:
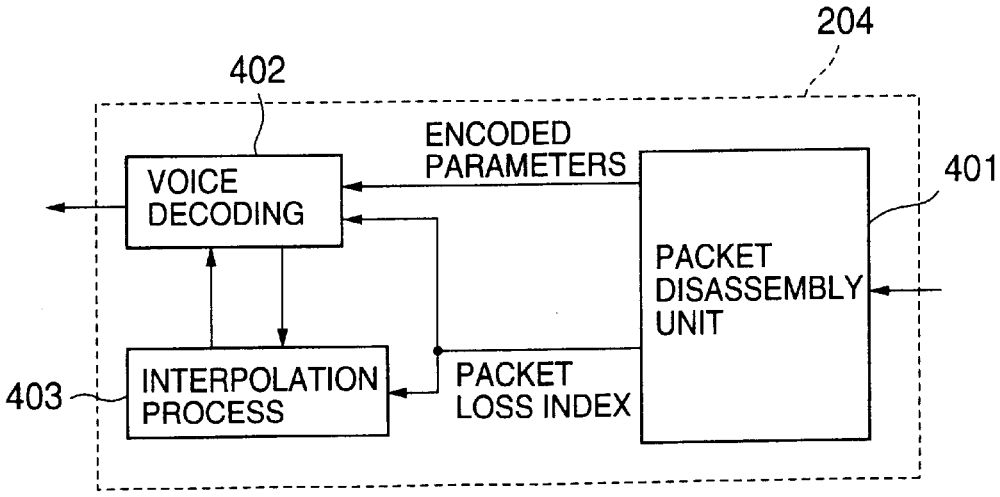
FIG. 4 shows a basic structure for performing a conventional interpolation method on the receiving end.
Figure 13:
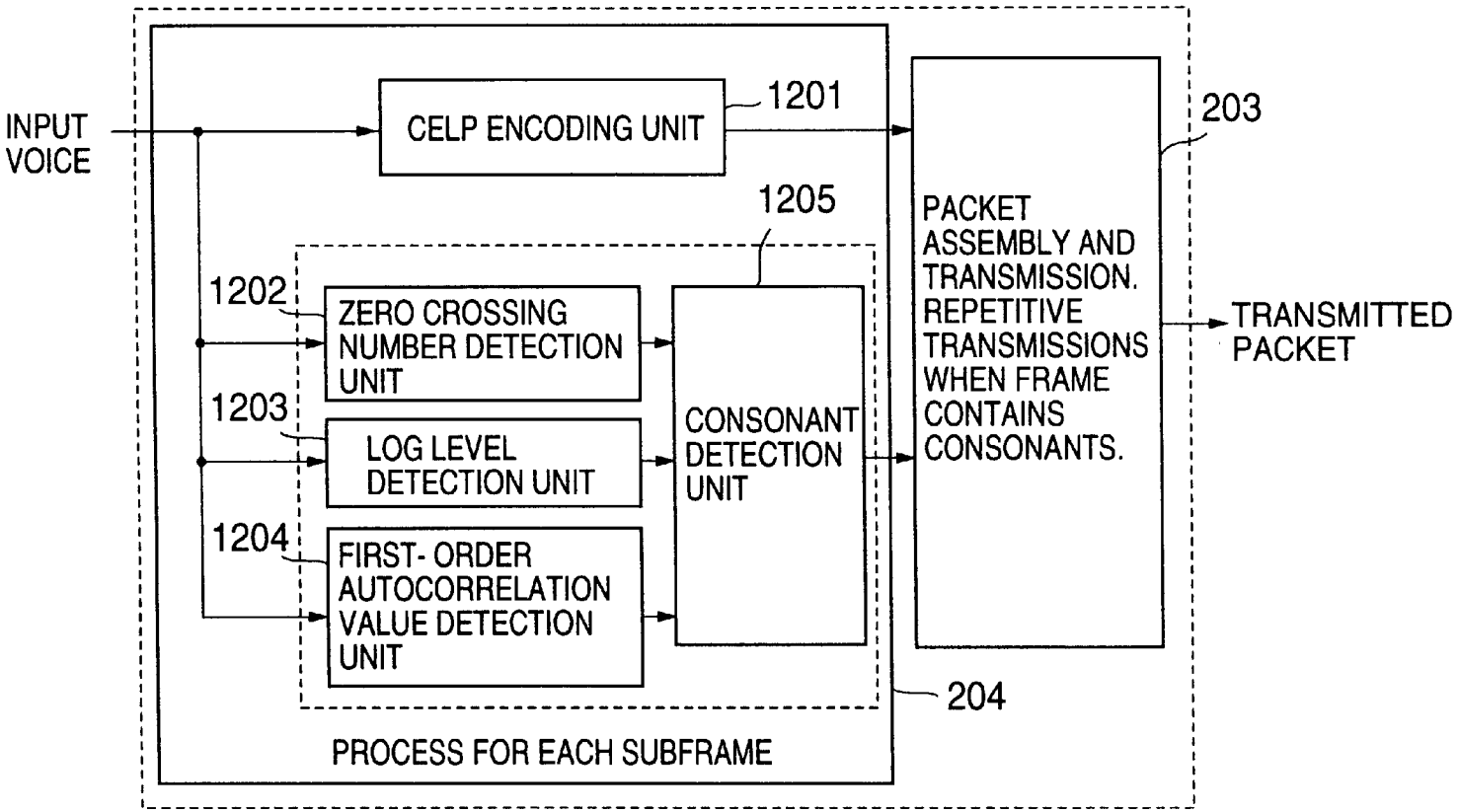
FIG. 13 is a block diagram of the transmission side according to a fourth embodiment of the present invention.
Figure 14A:
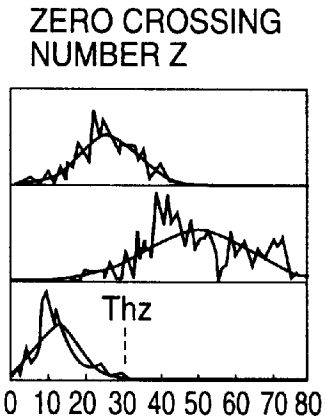
FIGS. 14A through 14C show examples of distributions of a zero crossing number Z, a log level L, and a first-order autocorrelation value R, respectively.
Figure 14B:
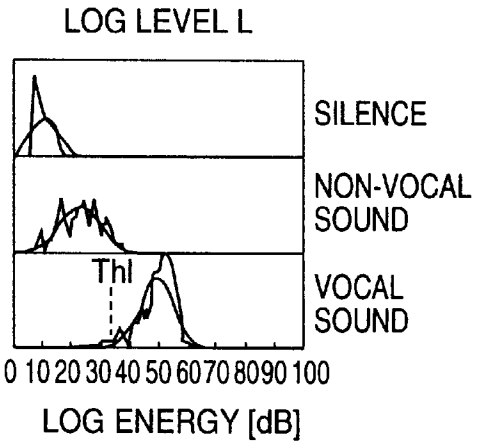
Figure 14C:
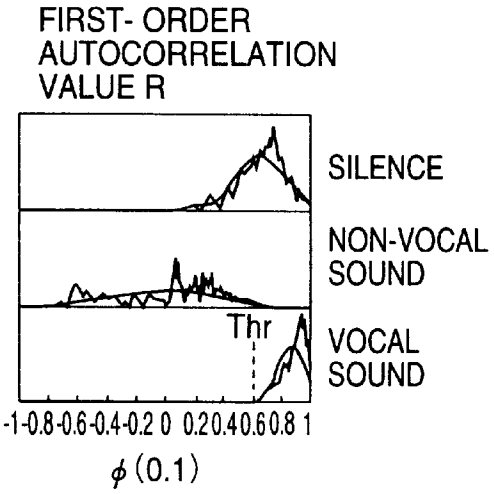

A fourth embodiment of the present invention will be described hereafter. FIG. 13 is a block diagram of the fourth embodiment of the present invention. FIG. 13 shows a structure of the transmission side which principally includes the voice encoding unit 204 and the packet assembly unit 203. The voice encoder unit 204 further includes a CELP encoding unit 1201, a zero crossing number detection unit 1202, a log level detection unit 1203, a first-order autocorrelation detection unit 1204 and a consonant interval detection unit 1205. FIGS. 14A through 14C show examples of distributions of a zero crossing number Z, a log level L, and a first-order autocorrelation value R, respectively. In the present embodiment, consonant intervals are detected by the consonant interval detection unit 1205 for each subframe of a target frame. The consonant interval detection is performed by calculating the zero crossing number-Z, the log level L, and the first-order autocorrelation value R for each of the subframes. The obtained values are then compared with predetermined threshold values Thz, Thl, and Thr of the zero crossing number, the log level, and the first-order autocorrelation value, respectively. If three conditions Z>Thz, L<Thl, and R>Thr are satisfied, then, the subframe is determined to be that of a consonant interval. Further, if a frame includes at least one consonant interval, then, the frame is determined to be a consonant frame. A method to determine each of the vowel, consonant and silent intervals is described in, for example, "A Pattern Recognition Approach to Voiced-Unvoiced-Silence Classification with Application of Speech Recognition", IEEE Transaction on ASSP, ASSP-24, No.3, July 1976, pp. 201–212. The present embodiment employs a method based on the properties shown in FIGS. 2, 3 and 4 of this paper.

Figure 15:
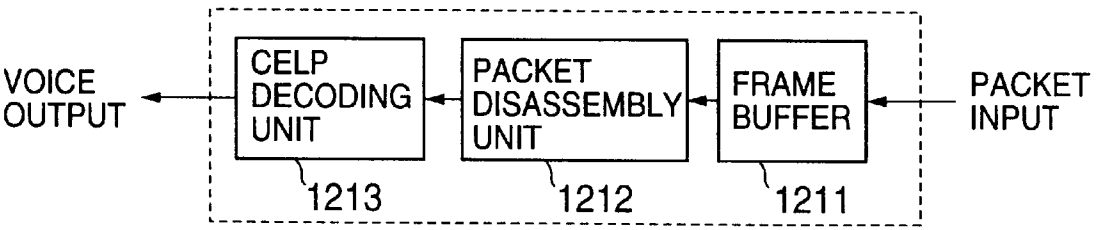
FIG. 15 is a block diagram of the receiving end.

FIG. 15 is a block diagram of the receiving end. The receiving end includes a frame buffer 1211, a packet disassembly unit 1212 and a CELP decoding unit 1213. As a precaution against packet loss, the frame buffer 1211 waits for an arrival of a packet during a time period in which the same packet is transmitted a number of times with the same sequence number attached thereto. When the packet having the same sequence number as a lost packet attached thereto is received, frame decoding is performed based on the received packet. The entire process in FIG. 15 may be implemented by using a firmware process of a DSP (Digital Signal Processor).

Further, the present invention is not limited to these embodiments, but various variations and modifications may be made without departing from the scope of the present invention.

The present application is based on Japanese priority application No. 2000-361874 filed on Nov. 28, 2000, with the Japanese Patent Office, the entire contents of which are hereby incorporated by reference.

What is claimed is:

1. A voice encoding method, comprising the steps of:

encoding a first frame that contains a plurality of voice data into encoded parameters;

locally decoding the encoded parameters of said first frame into a second frame;

performing a plurality of interpolation recovery processes that generate respective frames approximating to said first frame by using a frame or frames other than said first frame;

comparing said second frame with the frames approximating to said first frame generated by said plurality of interpolation recovery processes, calculating a signal to noise ratio of each of said frames approximating to said first frame by treating said second frame as the signal, and determining an index number that indicates an interpolation recovery process which provides a highest signal to noise ratio; and multiplexing and transmitting said index number with said encoded parameters.

2. The method as claimed in claim 1, wherein said frame or frames other than said first frame is a frame that precedes said first frame.

3. The method as claimed in claim 1, wherein said frame or frames other than said first frame are frames that precede said first frame as well as frames that follow said first frame.

4. The method as claimed in claim 1, wherein said step of multiplexing and transmitting transmits said index number by loading said index number in an area other than areas that serve to contain encoded parameters in a packet.

5. The method as claimed in claim 1, wherein said step of multiplexing and transmitting transmits said index number by loading said index number in an area where an error sensitivity is a lowest among areas that serve to contain encoded parameters in a packet.

6. A voice encoding method, comprising the steps of:

encoding a first frame that contains a plurality of voice data into encoded parameters;

detecting whether a consonant is included in said first frame; and transmitting said first frame a number of times with an identical sequence number attached thereto, if said first frame contains a consonant.

7. A voice encoding method, comprising the steps of:

encoding said first frame that contains a plurality of voice data into encoded parameters;

detecting whether a consonant is contained in said first frame; and transmitting said first frame by attaching thereto information indicative of higher priority if said first frame contains a consonant.

8. A voice encoding method, comprising the steps of:

encoding a first frame that contains a plurality of voice data into encoded parameters;

locally decoding the encoded parameters of said first frame into a second frame;

performing a plurality of interpolation recovery processes that generate respective frames approximating to said first frame by using a frame or frames other than said first frame;

comparing said second frame with the frames approximating to said first frame generated by said plurality of interpolation recovery processes, calculating a signal to noise ratio of each of said frames approximating to said first frame by treating said second frame as the signal, and determining an index number that indicates an interpolation recovery process which provides a highest signal to noise ratio;

detecting whether a consonant is contained in said first frame; and multiplexing said index number with said encoded parameters and transmitting the multiplexed index number and encoded parameters a number of times by attaching an identical sequence number thereto if said first frame contains a consonant.

9. The method as claimed in claim 8, wherein said frame or frames other than said first frame are frames that precede said first frame as well as frames that follow said first frame.

10. A voice encoding method, comprising the steps of:

encoding a first frame that contains a plurality of voice data into encoded parameters;

locally decoding the encoded parameters of said first frame into a second frame;

performing a plurality of interpolation recovery processes that generate respective frames approximating to said first frame by using a frame or frames other than said first frame;

comparing said second frame with the frames approximating to said first frame generated by said plurality of interpolation recovery processes, calculating a signal to noise ratio of each of said frames approximating to said first frame by treating said second frame as the signal, and determining an index number that indicates an interpolation recovery process which provides a highest signal to noise ratio;

detecting whether a consonant is contained in said first frame; and multiplexing said index number with said encoded parameters and transmitting the multiplexed index number and encoded parameters by attaching thereto information indicative of higher priority if said first frame contains a consonant.

11. A voice encoding apparatus, comprising:

a unit which divides a voice signal into sections of a short time period, and extracts voice parameters therefrom to construct a voice frame;

a unit which reproduces a first voice from a current voice frame;

a unit which generates a plurality of voice frames by a plurality of interpolation processes using voice frames other than the current voice frame;

a unit which reproduces a plurality of second voices from said plurality of voice frames;

a unit which outputs identification information indicative of an interpolation process that reproduces the second voice that is closest to said first voice; and a unit which multiplexes and transmits said identification information and said current voice frame.

* * * * *